US011591138B1

(12) United States Patent
Peters

(10) Patent No.: US 11,591,138 B1
(45) Date of Patent: Feb. 28, 2023

(54) BEVERAGE CAN COUPLER ASSEMBLY

(71) Applicant: William James Peters, York, PA (US)

(72) Inventor: William James Peters, York, PA (US)

(73) Assignee: Guzzle Gear LLC, York, PA (US)

( * ) Notice: Subject to any disclaimer, the term of this patent is extended or adjusted under 35 U.S.C. 154(b) by 0 days.

(21) Appl. No.: 16/869,616

(22) Filed: May 8, 2020

Related U.S. Application Data

(60) Provisional application No. 62/920,612, filed on May 8, 2019.

(51) Int. Cl.
*B65D 25/20* (2006.01)
*B65D 25/38* (2006.01)

(52) U.S. Cl.
CPC ..... *B65D 25/20* (2013.01); *B65D 25/38* (2013.01)

(58) Field of Classification Search
CPC ..... B65D 47/36; B65D 81/3205; B65D 81/3211; B65D 25/20; B65D 25/38
See application file for complete search history.

(56) References Cited

U.S. PATENT DOCUMENTS 1,933,192 A * 10/1933 Taylor ..... B67B 7/28 222/88
5,342,346 A * 8/1994 Honda ..... A61J 1/2089 604/411
5,630,529 A * 5/1997 Chlupp ..... B67D 3/0083 222/88
8,424,713 B2 * 4/2013 Bolland ..... A47G 23/0266 220/741
9,914,630 B2 * 3/2018 Takei ..... B67D 1/1416
2008/0135554 A1 * 6/2008 Hill ..... B65D 81/052 220/215
2018/0236469 A1 * 8/2018 Kurchev ..... B05B 15/65

* cited by examiner

*Primary Examiner* — Andrew T Kirsch
(74) *Attorney, Agent, or Firm* — Joseph E. Maenner; Maenner & Associates, LLC

(57) ABSTRACT

A beverage can coupler includes a rigid cylindrical body having a first internal portion and a second internal portion. A spacer is located inside the body and separates the first internal portion from the second internal portion. The spacer has a through opening therein to allow fluid communication between the first internal portion and the second internal portion. A first piercing member is attached to the spacer and extends into the first internal portion and a second piercing member is attached to the spacer and extends into the second internal portion.

20 Claims, 7 Drawing Sheets

BEVERAGE CAN COUPLER ASSEMBLY

CROSS-REFERENCE TO RELATED APPLICATION

The present application claims priority from U.S. Provisional Patent Application Ser. No. 62/920,612, filed on May 8, 2019, which is incorporated herein by reference in its entirety.

BACKGROUND OF THE INVENTION

Field of the Invention

The present invention relates to coupler device assembly that connects two beverage cans to each other so that both can be drunk simultaneously.

Description of the Related Art

"Shotgunning" is a term used to quickly drink a can of a beverage by puncturing an air hole toward the bottom of the can, holding the can upside down, and then pulling the pull tab. The punctured air hole allows air to enter the can so that the contents of the can can quickly flow out of the can.

In order to be able to "Shotgun" multiple beverage cans simultaneously, a coupler is required to couple two cans together and to allow for simultaneous flow from both cans.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a beverage can coupler that includes a rigid cylindrical body having a first internal portion and a second internal portion. A spacer is located inside the body and separates the first internal portion from the second internal portion. The spacer has a through opening therein to allow fluid communication between the first internal portion and the second internal portion. A first piercing member is attached to the spacer and extends into the first internal portion and a second piercing member is attached to the spacer and extends into the second internal portion.

In another embodiment, the present invention is a beverage can coupler comprising a tubular body extending along a longitudinal axis and a spacer attached to the body and separating the body into a first internal portion and a second internal portion. A first piercing member is attached to the spacer and extending into the first internal portion; and a second piercing member is attached to the spacer and extending into the second internal portion.

In yet another embodiment, the present invention provides a beverage can coupler comprising a rigid body having a cylindrical internal diameter and a spacer attached to the body and separating the sleeve into a first internal portion and a second internal portion. A first piercing member is attached to the spacer and extends into the first internal portion. A second piercing member is attached to the spacer and extends into the second internal portion. At least one of the spacer and the first and second piercing members has at least one through opening providing fluid communication between the first internal portion and the second internal portion.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 2:
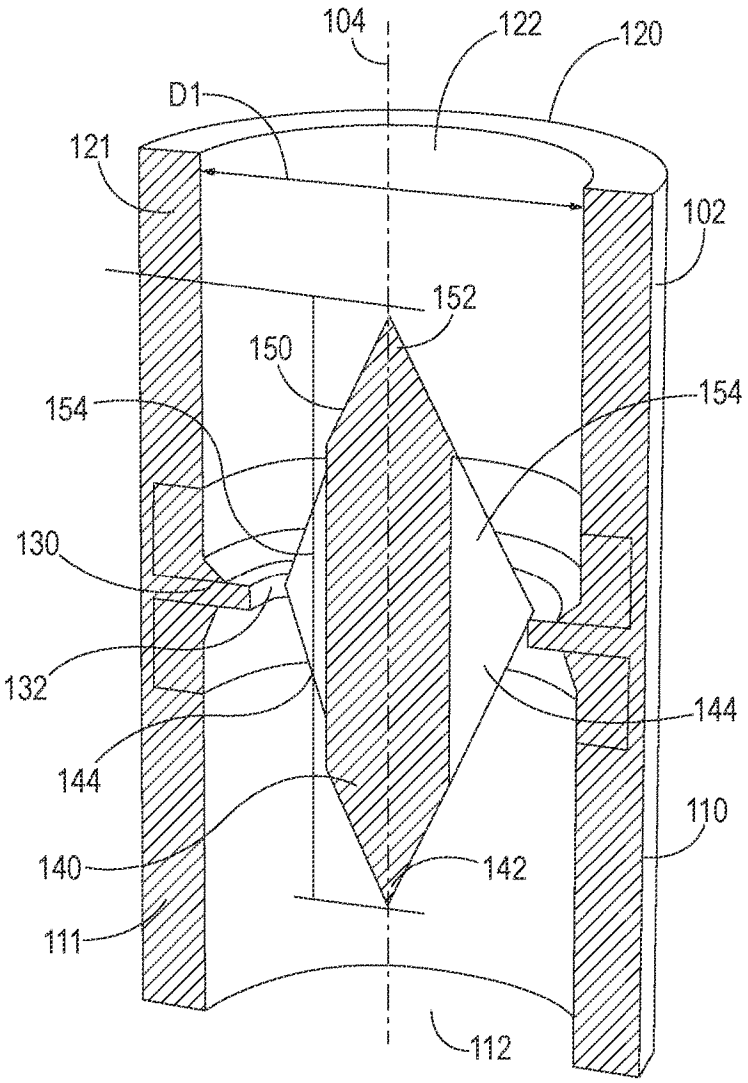
FIG. 2 is a sectional view of the coupler of FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention is a beverage can coupler that couples two beverage cans together on top of one another so that the beverage from both cans can be drunk simultaneously. The coupler allows first beverage can to be slid into a first end of the coupler and a second beverage can to be slid into a second end of the coupler. As each can is slid into the coupler, the can is pierced by a piercing mechanism inside the coupler, allowing liquid to flow from one can to the other.

In an exemplary embodiment, as shown in FIGS. 1-5 a beverage can coupler 100 ("coupler 100") couples a first beverage can 50 to a second beverage can 60. In this embodiment, the top 52 of can 50 and the bottom 62 of can 60, respectively are inserted into coupler 100.

Figure 1:
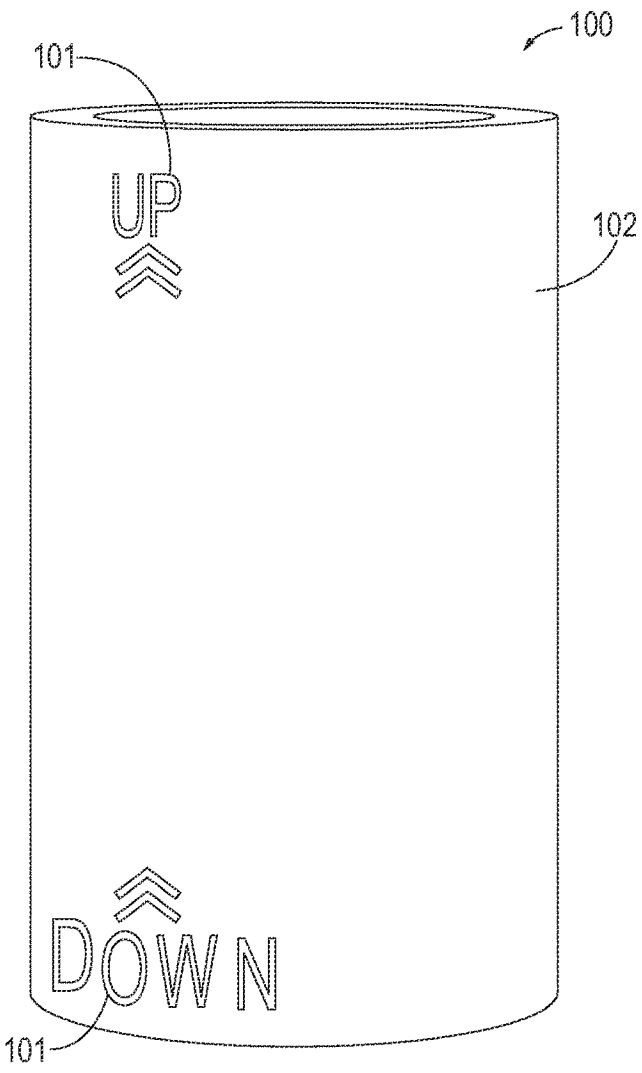
FIG. 1 is a front elevational view of a multiple beverage can coupler according to an exemplary embodiment of the present invention.

Coupler 100 comprises a rigid cylindrical body 102 in the shape of a tubular sleeve that extends along a longitudinal axis 104. In an exemplary embodiment, body 102 can be constructed from a rigid polymer, such as, for example, a filled nylon (glass or mineral) or an ABS plastic. Body 102 has a cylindrical internal diameter Dl. In an exemplary embodiment, as shown in FIG. 1, indicia 101 can be printed on the exterior of body 102 to indicate orientation of coupler 100.

Body 102 includes a first internal portion 110 defined by a wall 111 having a first opening 112 that is sized to allow at least a part of first can 50 to be inserted therein and a second internal portion 120 defined by a wall 121 having a second opening 122, distal from first opening 112, that is sized to allow at least a part of second can 60 to be inserted therein.

Figure 3:
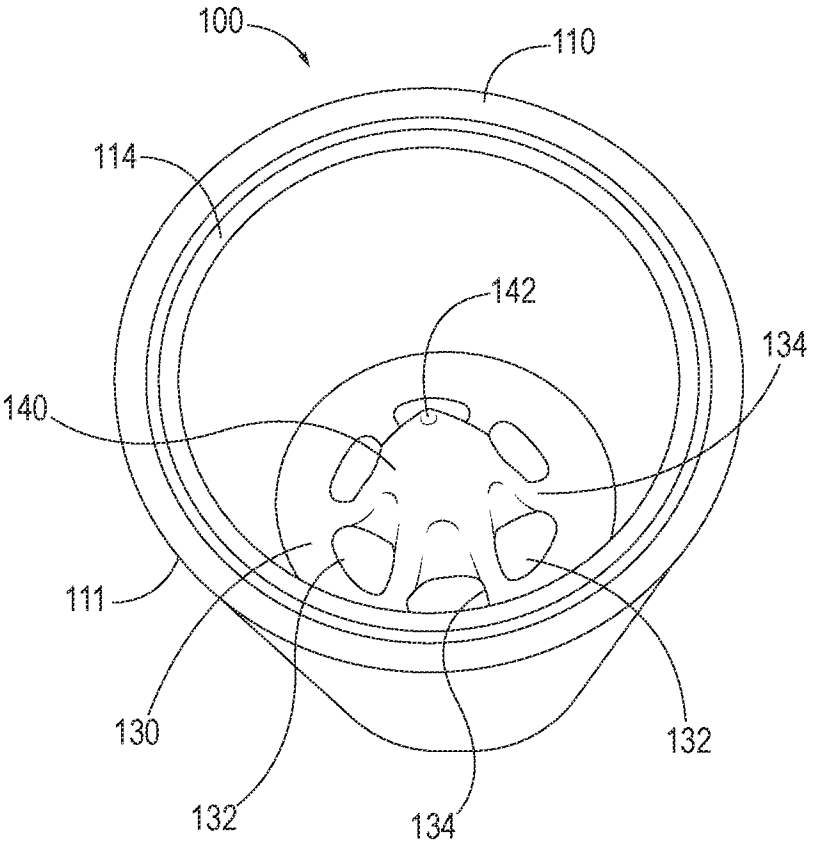
FIG. 3 is a bottom perspective view of the coupler of FIG. 1.
Figure 5:
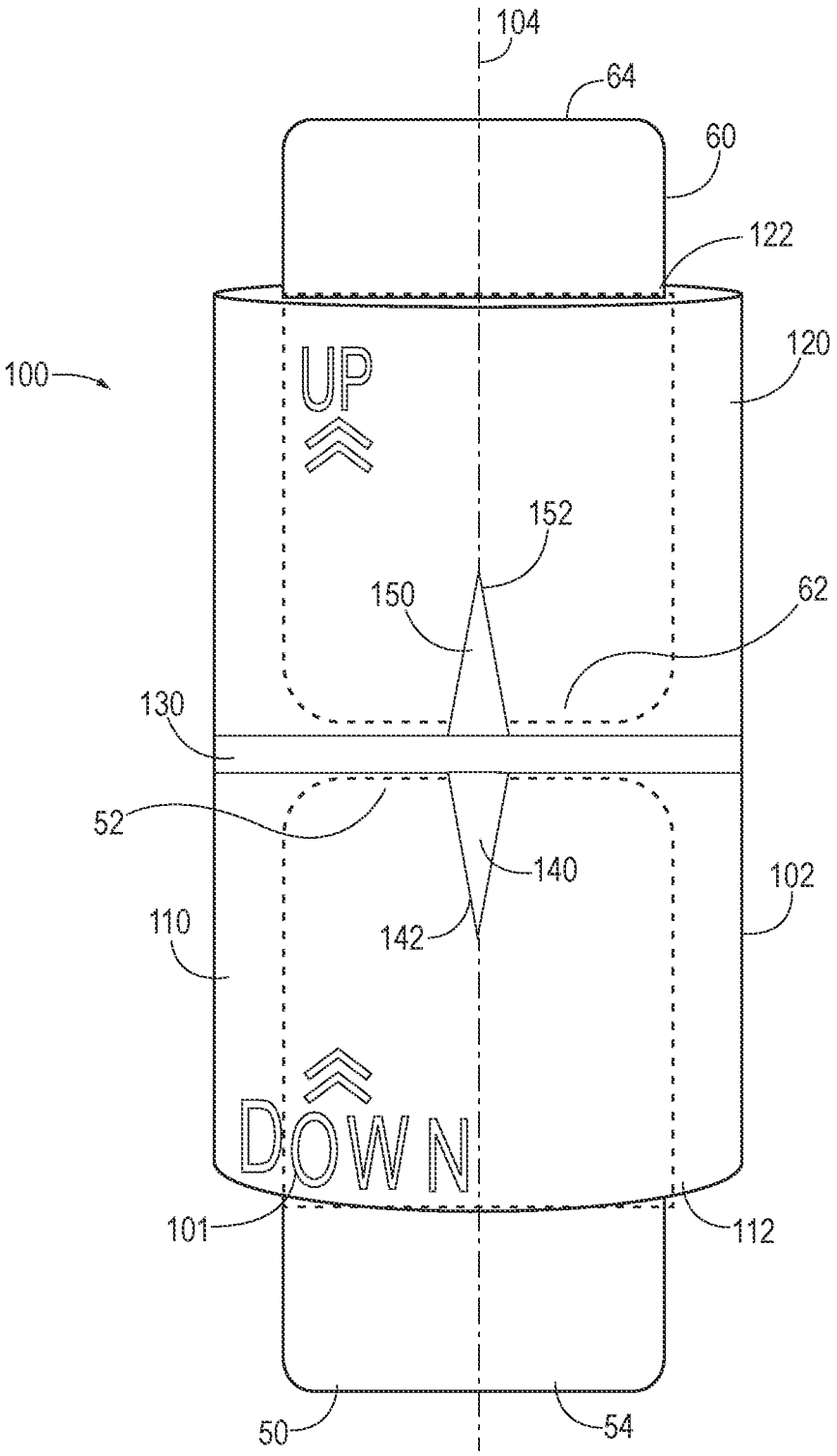
FIG. 5 is a front elevational view of the coupler of FIG. 1, with a first beverage can inserted into a first end of the coupler and a second beverage can inserted into a second end of the coupler.

A compressible tubular sleeve 114, shown in FIG. 3, circumferentially lines wall 111 of first internal portion 110. Similarly, a compressible tubular sleeve 124 circumferentially lines wall 121 of second internal portion 120. Each of sleeve 114, 124 has an inner diameter sized to receive a beverage can 50, 60 such that a liquid impermeable seal is formed around the exterior of beverage cans 50, 60 when beverage cans 50, 60 are inserted into coupler 100. In an exemplary embodiment, sleeves 114, 124 can be constructed from a compressible foam or other compressible material.

A spacer 130 is located inside and is attached to body 102 and separates first internal portion 110 from second internal portion 120. In an exemplary embodiment, spacer 130 extends in a plane perpendicular to longitudinal axis 104 half way between first opening 112 and second opening 124 such that coupler 100 is symmetrical about spacer 130. In an exemplary embodiment, spacer 130 has at least one, and in an exemplary embodiment, a plurality of through openings 132 therein that allow fluid communication between first internal portion 110 and second internal portion 120.

A first piercing member 140 is attached to spacer 130 and extends into the first internal portion 110. First piercing member 140 includes a spiked tip 142 that can be used to pierce beverage can 50 when beverage can 50 is inserted into first internal portion 110.

Similarly, a second piercing member 150 is attached to spacer 130, distal from first piercing member 140, and extends into second internal portion 120. Second piercing member 150 includes a spiked tip 152 that can be used to pierce beverage can 60 when beverage can 60 is inserted into second internal portion 120.

Spiked tips 142, 152 extend co-axially along longitudinal axis 104 and can optionally include at least one, or a plurality of through openings, 144, 154, as shown in FIG. 2.

Figure 4:
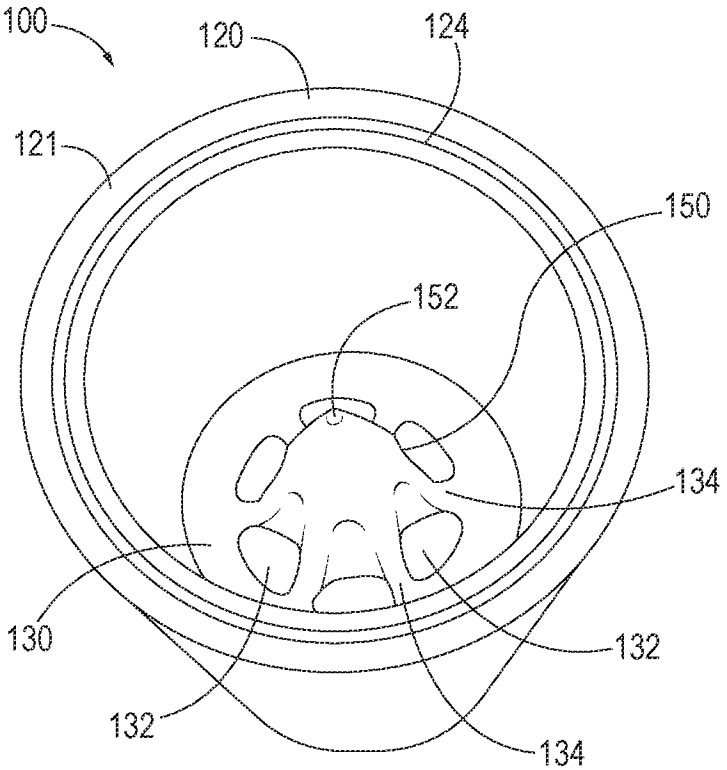
FIG. 4 is a top perspective view of the coupler of FIG. 1.

In FIGS. 3 and 4, where through openings 132 are in spacer 130, through openings 132 are radially spaced around first piercing member 140 and second piercing member 150. In this embodiment, spacer 130 comprises a plurality of ribs 134 that extending radially away from tips 142, 152, such that each of the plurality of ribs 134 separates adjacent through openings 132 of the plurality of through openings 132.

Figure 6:
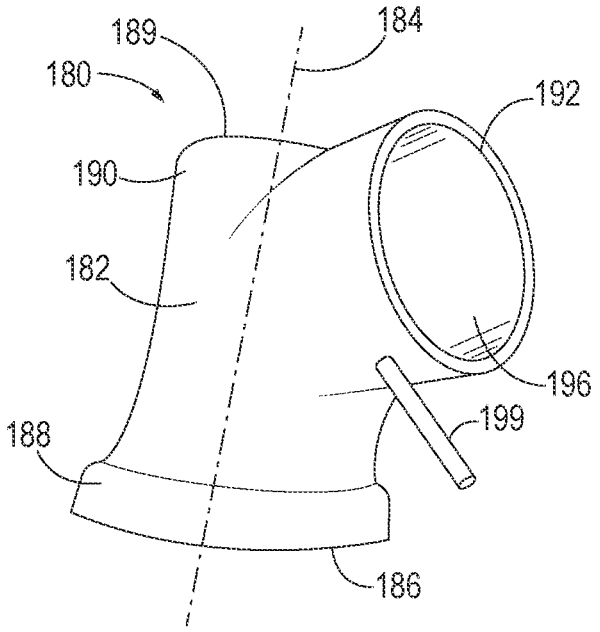
FIG. 6 is a perspective view of a vent that is attachable to a beverage can.
Figure 7:
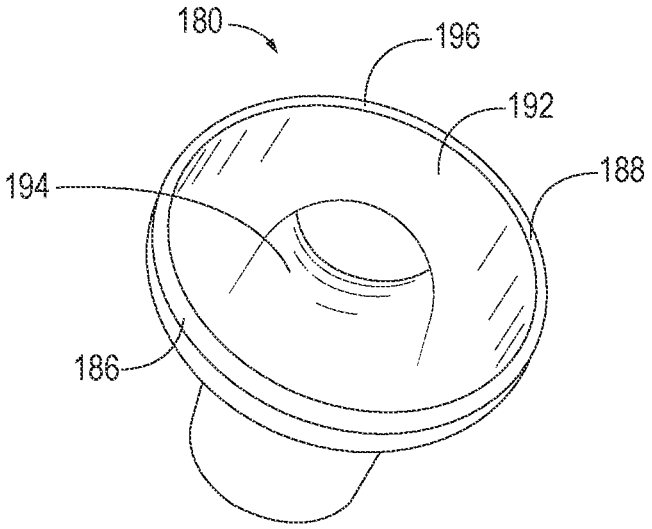
FIG. 7 is a bottom perspective view of the vent of FIG. 7.
Figure 8:
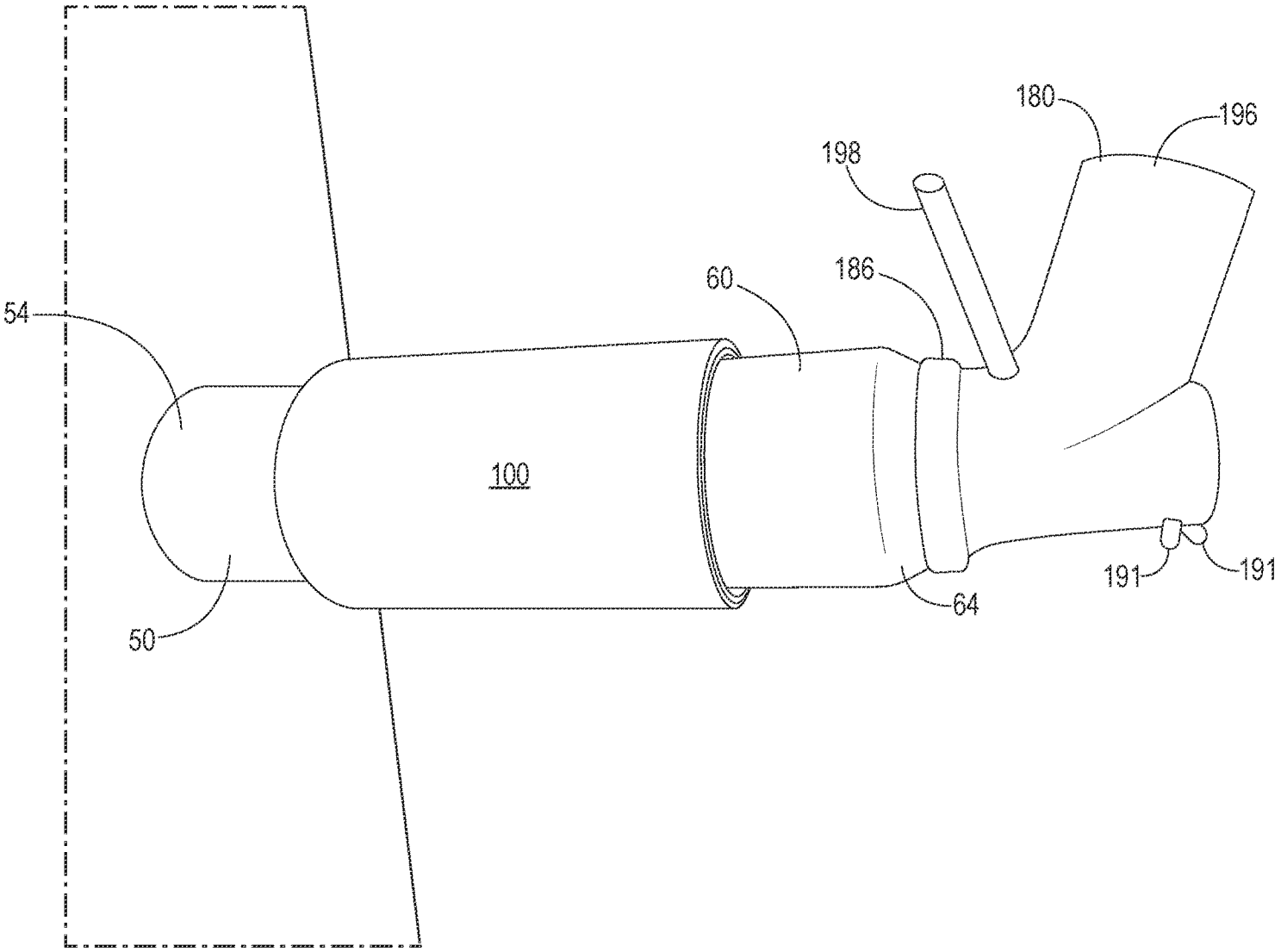
FIG. 8 is a side elevational view of the coupler coupling two beverage cans and the vent of FIGS. 6 and 7 attached to one of the cans.

A vent 180 is shown in FIGS. 6-8. Vent 180 is removably attached to beverage can 60 after the flip top to beverage can 60 is opened. Vent 180 prevents liquid from spilling when beverage cans 50, 60 are tipped sideways.

Figure 8A:
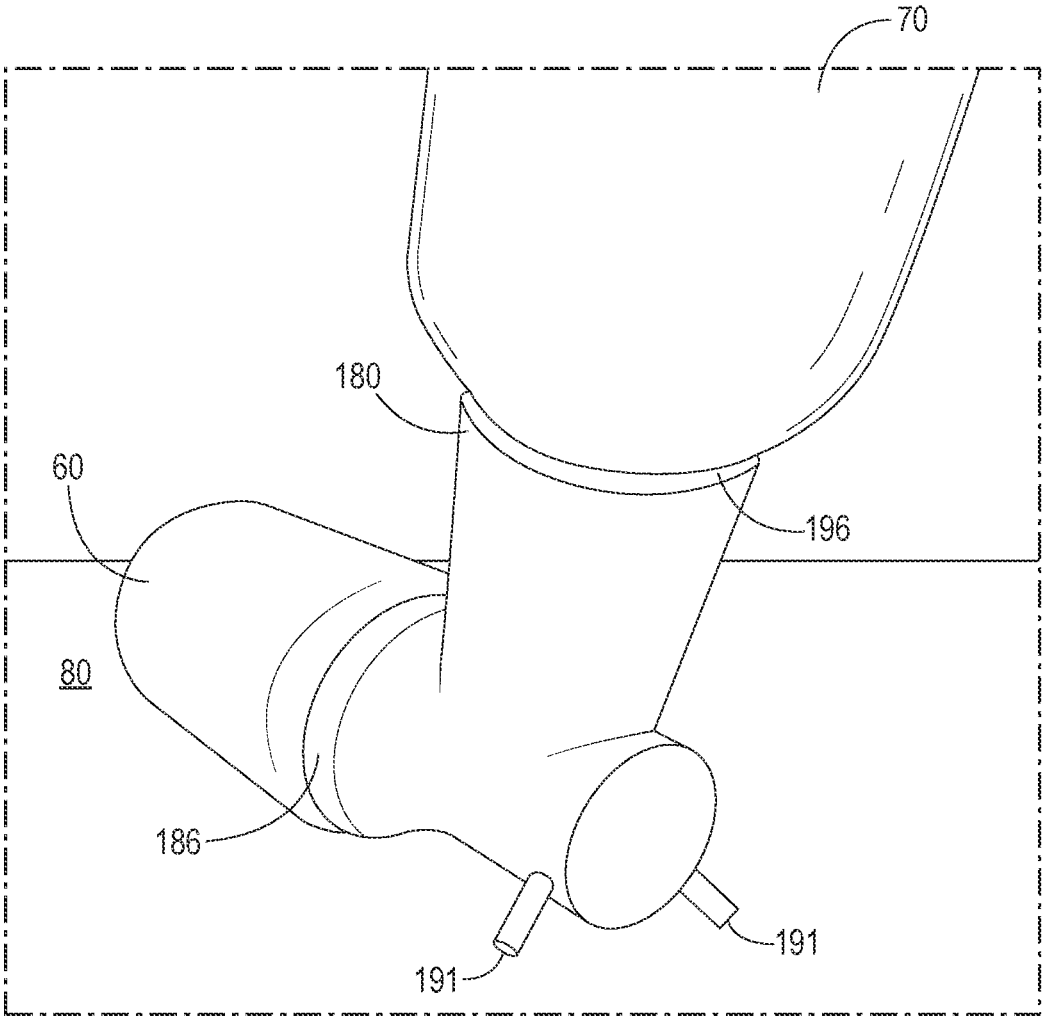
FIG. 8A is a perspective view of the vent of FIG. 6 coupled to a beverage can and a beverage bottle.

Vent 180 includes a hollow vent body 182 extending along a longitudinal axis 184. An open can coupling portion 186 is located at a first end 188 of vent body 182 and a closed portion 189 is located at a second end 190 of vent body 182. Two nubs 191, shown in FIG. 8, can extend from closed portion 189 and act as feet to stabilize vent 180 when vent 180 (attached to cans 50, 60 and coupler 100) is placed on a table 80 (shown in FIG. 8A). A first vent portion 192 is in fluid communication with hollow vent body 182 and has an arcuate passage 194 with an open vent end 196. A second vent portion 198 is located between first vent portion 192 and can coupling portion 186 and is in fluid communication with hollow vent body 182. Second vent portion 198 has an open end 199 that opens to atmosphere.

To use coupler 100, a beverage can 50 is placed right side up so that a bottom 54 of beverage can 50 is on a stable surface, such as on a table or counter (not shown). Beverage can 50 can be opened in a normal fashion by opening the flip top. The flip top can be removed from beverage can 50. Coupler 100 is placed over top 52 of can 50 so that first internal portion 110 extends around the perimeter of can 50. Coupler is pressed downwardly onto can 50 so that spiked tip 132 of first piercing member 130 pierces the top 52 of can 50.

Next, bottom 62 of second can 60 is placed over coupler 100 so that second internal portion 120 extends around perimeter of can 60. Can 60 is pressed downwardly into coupler 100 so that spiked tip 142 of second piercing member 140 pierces bottom 62 of can 60. The flip top on top 64 of can 60 is opened, exposing the top inside of can 60 to atmosphere. Fluid from can 60 is in fluid communication with fluid in can 50 via through openings 132 in spacer 130 and/or through openings 144, 154 in piercing members 140, 150. Compressible sleeves 114, 124 provide a liquid impermeable seal between each of cans 50, 60 and coupler 100 so that liquid from can 60 does not pour out between the side of can 50 and coupler 100.

As shown in FIG. 8, vent 180 is placed over top 64 of can 60 such that coupling portion 186 of vent 180 extends over the outside of can 60. The entire assembly 100, 50, 60, 180 is flipped sideways so that open vent end 196 is facing upwardly and a hole is punctured in the side wall of can 50, proximate to the bottom 54. Fluid from can 60 can spill into vent body 182 but does not spill out of vent 180, remaining in vent body 182.

To drink the fluid in cans 50, 60, the user tilts the assembly 100, 50, 60, 180 vertically, allowing fluid from both cans 50, 60 to pour out from the punctured hole in can 50 and (hopefully) into the person's mouth.

Instead of using coupler 100 and vent 180 with two beverage cans 50, 60, coupler 100 can be omitted and vent 180 can be used with beverage can 60 and a bottle 70. Can 60 is inserted into vent 180 as shown in FIG. 8, but the open end of bottle 70 is inserted into first vent portion 192. The user then places their mouth over open end 199 of second vent portion 198 and drinks the liquid from both can 60 and bottle 70.

Figure 9:
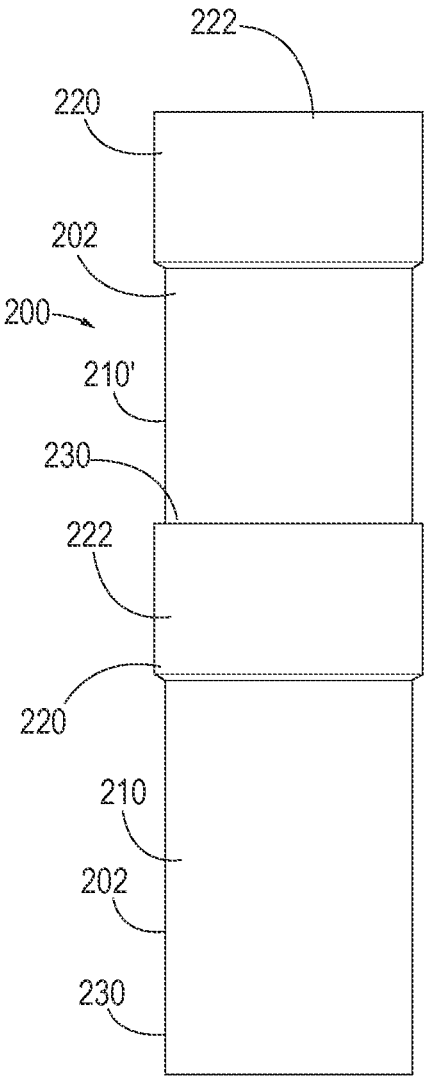
FIG. 9 is a side elevational view of a coupler assembly for coupling more than two cans according to an alternative exemplary embodiment of the present invention.
Figure 10:
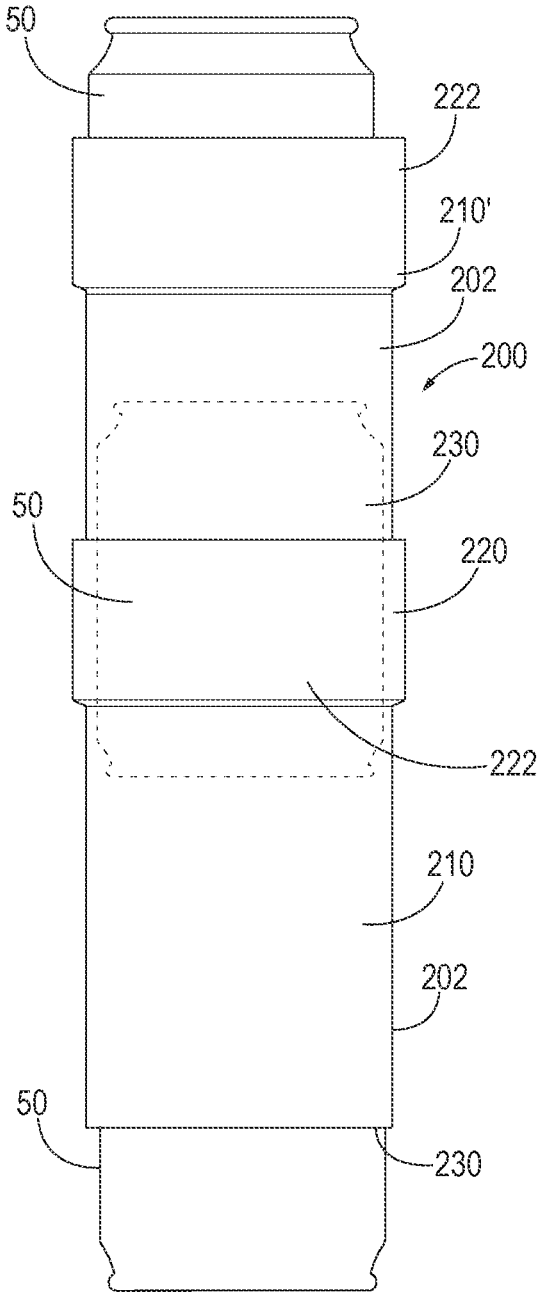
FIG. 10 is a side elevational view of the coupler assembly of FIG. 9, with three cans coupled together using the assembly.

FIGS. 9 and 10 show a coupler assembly 200 that can be used to stack more than two cans 50 together for simultaneous consumption. Coupler assembly 200 includes at least two couplers 210, 210' that can be stacked on top of each other. While two couplers 210, 210' are shown in FIGS. 9 and 10 and three cans 50 are shown in FIG. 10, those skilled in the art will recognize that more than two couplers 210, 210' and more than three cans 50 can be used.

Couplers 210, 210' are identical to coupler 100 with the exception that couplers 210, 210' each includes a body 202 having a top portion 220 with a lip 222 that allows a bottom portion 230 of an adjacent coupler 210' to fit within lip 222. An interior of lip 222 can include a resilient material (not shown) to form a seal between the interior of lip 222 and bottom portion 230 of adjacent coupler 210' to reduce leakage between coupler 210 and coupler 210'.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A beverage can coupler comprising:

a rigid cylindrical body having a first internal portion and a second internal portion;

a spacer inside the body and separating the first internal portion from the second internal portion, the spacer having a plurality of spacer through openings therein to allow fluid communication between the first internal portion and the second internal portion;

a first piercing member attached to the spacer and extending into the first internal portion, the first piercing member having a plurality of piercing member through openings extending radially therearound, and wherein the plurality of spacer through openings extend radially around the piercing member such that each of the plurality of piercing member through openings is continuous with one of the plurality of spacer through openings; and a second piercing member attached to the spacer and extending into the second internal portion, wherein the first internal portion is sized to allow a first beverage can to slide thereinto, a portion of the first beverage can being located externally to the coupler, and wherein the second internal portion is sized to allow a second beverage can to slide thereinto, exposing a portion of the second beverage can externally to the coupler.

2. The beverage can coupler according to claim 1, further comprising a sleeve circumferentially lining the first internal portion.

3. The beverage can coupler according to claim 2, wherein the sleeve comprises a compressible material.

4. The beverage can coupler according to claim 1, wherein the spacer through opening comprises a plurality of spacer through openings.

5. The beverage can coupler according to claim 4, wherein the plurality of spacer through openings are radially spaced around the first piercing member.

6. The beverage can coupler according to claim 5, wherein the first piercing member comprises a tip and a plurality of ribs extending radially away from the tip.

7. The beverage can coupler according to claim 6, wherein each of the plurality of ribs separates adjacent spacer through openings of the plurality of spacer through openings.

8. A beverage can coupler assembly comprising:

a coupler comprising:

a tubular body extending along a longitudinal axis;

a spacer attached to the body and separating the body into a first internal portion and a second internal portion;

a first piercing member attached to the spacer and extending into the first internal portion; and a second piercing member attached to the spacer and extending into the second internal portion and a vent comprising:

a hollow vent body extending along a longitudinal axis;

an open can coupling portion at a first end of the vent body;

a closed portion at a second end of the vent body;

a vent portion in fluid communication with the hollow vent body, the vent portion having an arcuate passage curving away from the longitudinal axis and an open vent end; and at least one foot extending outwardly from the vent body to facilitate stabilization of the assembly on a horizontal surface.

9. The beverage can coupler according to claim 8, wherein the first internal portion is in fluid communication with the second internal portion.

10. The beverage can coupler according to claim 9, wherein the fluid communication is provided by a through opening formed in the spacer.

11. The beverage can coupler according to claim 8, further comprising a compressible material inside the tubular body.

12. The beverage can coupler according to claim 11, wherein the compressible material comprises a compressible foam.

13. The beverage can coupler according to claim 8, wherein the first piercing member comprises a spike.

14. The beverage can coupler according to claim 13, wherein the spike extends along the longitudinal axis.

15. The beverage can coupler according to claim 13, further comprising a plurality of through holes formed in the spike.

16. The beverage can coupler according to claim 8, wherein the tubular body has an inner diameter sized to receive a beverage can.

17. A vent comprising:

a hollow vent body extending along a central longitudinal axis;

an open can coupling portion at a first end of the vent body, the open can coupling portion extending along the central longitudinal axis;

a closed portion at a second end of the vent body;

a first vent portion in fluid communication with the hollow vent body, the first vent portion having an arcuate passage curving away from the central longitudinal axis and extending from the body at an oblique angle relative to the central longitudinal axis and an open vent end;

and at least one foot extending outwardly from the vent body to facilitate stabilization of the vent body on a horizontal surface.

18. The vent according to claim 17, further comprising a second vent portion extending outwardly from the vent body.

19. The vent according to claim 18, wherein the second vent portion is located between the first vent portion and the can coupling portion.

20. The vent according to claim 18, wherein the second vent portion comprises an open end open to atmosphere.

* * * * *